US005211222A

United States Patent [19]

Shinmura

[11] Patent Number: 5,211,222

[45] Date of Patent: May 18, 1993

[54] HEAT EXCHANGER

[75] Inventor: Toshiharu Shinmura, Isesaki, Japan

[73] Assignee: Sanden Corporation, Gunma, Japan

[21] Appl. No.: 791,255

[22] Filed: Nov. 13, 1991

[30] Foreign Application Priority Data

Nov. 13, 1990 [JP] Japan ..... 2-306649

[51] Int. Cl.[5] ..... F28D 1/03

[52] U.S. Cl. ..... 165/176; 29/890.043; 165/153

[58] Field of Search ..... 165/153, 175, 176; 29/890.043, 890.039

[56] References Cited

U.S. PATENT DOCUMENTS

| | | | |
|---|---|---|---|
| 3,746,525 | 7/1973 | Kasuga et al. | 165/176 X |
| 4,396,060 | 8/1983 | Schenk | 165/176 |
| 4,515,305 | 5/1985 | Hagemeister | 228/173.2 |
| 4,589,265 | 5/1986 | Nozawa | 62/526 |
| 4,592,414 | 6/1986 | Beasley | 165/76 |
| 4,600,053 | 7/1986 | Patel et al. | 165/170 |
| 4,615,384 | 10/1986 | Shimada et al. | 165/152 |
| 4,621,685 | 11/1986 | Nozawa | 165/111 |
| 4,815,532 | 3/1989 | Sasaki et al. | 165/152 |
| 4,825,941 | 5/1989 | Hoshino et al. | 165/110 |
| 4,860,823 | 8/1989 | Noguchi | 165/153 |
| 4,932,469 | 6/1990 | Beatenbough | 165/153 |
| 4,969,512 | 11/1990 | Hisao et al. | 165/153 |
| 5,046,555 | 9/1991 | Nguyen | 165/173 |

FOREIGN PATENT DOCUMENTS

| | | | |
|---|---|---|---|
| 1807464 | 6/1970 | Fed. Rep. of Germany | 29/890.043 |
| 1062226 | 3/1967 | United Kingdom | 165/153 |
| 1256228 | 12/1971 | United Kingdom | 165/175 |

*Primary Examiner*—Allen J. Flanigan
*Attorney, Agent, or Firm*—Baker & Botts

[57] ABSTRACT

A laminated type evaporator for an automotive air conditioning refrigerant circuit is disclosed. The evaporator includes a plurality of tube units having a pair of tray-shaped plates. A pair of conduits for distributing the refrigerant to the interior region of each of the tube units and for receiving the refrigerant from the interior region of each of the tube units are connected to the top surface of the tube units. Communication between the plurality of tube units is obtained through separately formed conduits, thereby obviating the need to form an internal passageway during the formation of the tray-shaped plates and thus simplifying the manufacturing process of the evaporator.

14 Claims, 12 Drawing Sheets

HEAT EXCHANGER

BACKGROUND OF THE INVENTION

1. Field of the Invention

This invention relates generally to heat exchangers for refrigerant circuits and, more particularly, to a laminated type evaporator for an automotive air conditioning refrigerant circuit.

2. Description of the Prior Art

A laminated type evaporator is known in the prior art, as for example, Japanese Patent Application Publication No. 62-5097 which discloses an evaporator as shown in FIGS. 1-3. The evaporator 10 includes a plurality of tube units 11 of aluminum alloy each of which includes a pair of tray-shaped plates 12. Tray-shaped plates 12 include a shallow depression 120 defined therein, a flange 13 formed around the periphery thereof, and a narrow wall 14 formed in the central region thereof. Narrow wall 14 extends downwardly from an upper end of plate 12 and terminates approximately one-eighth the length of plate 12 away from the lower end thereof. Narrow wall 14 includes a flat top surface 14*a*. A plurality of diagonally disposed semicylindrical projections 15 project from the inner bottom surface of shallow depression 120. Semicylindrical projections 15 are aligned with one another in each of a plurality of, for example, four rows. As shown in FIG. 2, there are two rows of semicylindrical projections 15 located in shallow depression 120 on the right side of narrow wall 14 and two rows located on the left side thereof. Semicylindrical projections 15 also include a ridge 15*a* and are utilized in order to reinforce the mechanical strength of plate 12. A pair of cylindroid-shaped bulged portions 16 are formed in the upper region of plate 12 and project oppositely to semicylindrical projections 15 such that a hollow space 16*b* is defined by each bulged portion 16. An oval opening 16*a* is formed in the bottom surface of each bulged portion 16. A plurality of rectangular parallelepiped projections 17 project from the inner bottom surface of shallow depression 120 adjacent to the interior surface of each bulged portion 16. Each of the three rectangular parallelepiped projections 17 shown includes a flat top surface 17*a*. A rectangular flange 18 projects from the lower end of plate 12 in a direction opposite to semicylindrical projections 15, and is bent downwardly in a generally right angle at the terminal end thereof.

The levels of flat top surface 14*a* of narrow wall 14, ridge 15*a* of semicylindrical projections 15, and flat top surface 17*a* of parallelepiped projections 17 are even with the surface of flange 13. Therefore, when the pair of tray-shaped plates 12 are joined together by flanges 13 so as to form a passage 19 therebetween, narrow walls 14 of each plate 12 contact one another at the flat top surfaces 14*a*, parallelepiped projections 17 of each plate 12 contact one another at their flat top surfaces 17*a*, and semicylindrical projections 15 of plates 12 contact one another at the intersections 15*b* along ridges 15*a*. Flanges 13 of plates 12 are fixedly attached to each other by, for example, brazing or any other conventional manner, and flat top surfaces 14*a* of narrow walls 14 in plates 12 are also fixedly attached to each other by brazing, or on a like manner.

Evaporator 10 is formed by laminating together a plurality of tube units 11 and inserting corrugated fins 20 within the intervening space 21 between the adjacent tube units 11. Tube unit 11, located on the far left side of evaporator 10 shown in FIG. 1, includes a tray-shaped plate 12*a* having no bulged portion 16. Plate 12*a* is provided with a cylindroid-shaped tank 31 which is fixedly attached to the upper end thereof. The interior region of tank 31 is linked to hollow space 16*b* in the adjacent front side bulged portion 16 of plate 12 through an opening (not shown) formed in the upper end of plate 12*a*. Tube unit 11, located on the far right side of evaporator 10, also includes a tray-shaped plate 12*b* having no bulged portion 16. Plate 12*b* is provided with a cylindroid-shaped tank 32 which is fixedly attached to the upper end thereof. The interior region of tank 32 is similarly linked to hollow space 16*b* in the adjacent front side bulged portion 16 of plate 12 through an opening (not shown) formed in the upper end of plate 12*b*. Tank 31 is provided with a circular opening 31*a* formed in the front surface thereof. Tank 32 is provided with a circular opening 32*a* also formed in the front surface thereof. One end of an inlet pipe 50 is connected to opening 31*a* of tank 31 and one end of an outlet pipe 60 is connected to opening 32*a* of tank 32. Inlet pipe 50 is provided with a union joint 50*a* at the other end thereof and outlet pipe 60 is similarly provided with a union joint 60*a* at the other end thereof. A pair of side plates 22 are attached to the left side of plate 12*a* and to the right side of plate 12*b*, respectively, and corrugated fins 20 are disposed between side plate 22 and plate 12*a*, and between side plate 22 and plate 12*b*, respectively. The lower end of side plate 22 includes a rectangular flange 22*a* projecting inwardly and then bent downwardly in a generally right angle at the terminal end thereof. Respective tube units 11, corrugated fins 20, and side plates 22 are fixedly attached to one another by any conventional manner, such as brazing, for example. Although corrugated fins 20 are only illustrated in FIG. 1 at the upper and lower ends of intervening spaces 21, it should be understood that corrugated fins 20 continuously extend along the entire length of intervening spaces 21. In addition, although tray-shaped plate 12*c* located in the central region of evaporator 10 includes a pair of bulged portions 16, it should be noted that bulged portion 16 located on the front side of the evaporator does not have an oval opening 16*a*.

Latitudinally adjacent hollow spaces 16*b* of a pair of bulged portions 16 are linked to one another through oval openings 16*a*, thereby forming a pair of parallel conduits 30 and 40. Conduit 30 is located on the front side of evaporator 10 and conduit 40 is located on the rear side of evaporator 10. Conduit 30 is divided into left and right side sections 30*a* and 30*b* by plate 12*c* as shown in FIG. 1.

Referring also to FIG. 4, in the above-mentioned construction of the evaporator, when an automotive air conditioning refrigerant circuit operates, the refrigerant flows from the condenser (not shown) of the refrigerant circuit via a throttling device, such as an expansion valve, into the interior region of tank 31 through inlet pipe 50. The refrigerant in the interior region of tank 31 flows through left side section 30*a* of conduit 30 from the left side to the right side and concurrently flows into the upper right region of passage 19 of each of tube units 11. As shown in FIG. 2, the refrigerant in the upper right region of passage 19 then flows downwardly to the lower right region of passageway 19 in a complex flow path substantially formed from both diagonal and straight flow paths, as shown by the solid arrows in FIG. 2, while also exchanging heat with the air passing along corrugated fins 20. This complex flow path of the refrigerant enhances the heat exchangeability between the air and the refrigerant. The air passes through evaporator 10 from the front to the rear, as shown by the large narrow "A" in FIG. 4. The refrigerant located in the lower right region of passage 19 is turned at the terminal end of narrow wall 14 and directed to flow from the right side to the left side of passage 19 as shown by the solid arrows in FIG. 2. That is, the refrigerant flows from the front to the rear of passage 19, then flows upwardly to the upper left region of passage 19 in the complex flow path mentioned above while further exchanging heat with the air passing along corrugated fins 20, and finally, flows out of passage 19 of each of tube units 11. The refrigerant flowing out of passage 19 of each of tube units 11 combines together in conduit 40 and flows through conduit 40 from the left side to the right side thereof.

The refrigerant flowing through conduit 40, after passing through plate 12*c*, concurrently flows into the upper left region of passage 19 of each of tube units 11. The refrigerant in the upper left region of passage 19 then flows downwardly to the lower left region of passageway 19 in a complex flow path, like the aforementioned flow path, while exchanging heat with the air passing along corrugated fins 20. The refrigerant located in the lower left region of passage 19 is directed, at the terminal end of narrow wall 14, from the left side to the right side of passage 19. That is, the refrigerant flows from the rear to the front of passage 19, then flows upwardly to the upper right region of passage 19 in a complex flow path while further exchanging heat with the air passing along corrugated fins 20, and finally flows out of passage 19 of each of tube units 11. The refrigerant flowing out of passage 19 of each of tube units 11 combines together in the right side section 30*b* of conduit 30, and flows through the right side section 30*b* of conduit 30 from the left side to the right side thereof. The gaseous phase refrigerant located in the far right side of right side section 30*b* of conduit 30 flows into the interior region of tank 32 and then through outlet pipe 60 to the suction chamber of the compressor (not shown) of the refrigerant circuit.

In this prior art evaporator, the manufacturing process for plate 12 includes a drawing process for forming shallow depression 120, semicylindrical projections 15, parallelepiped projections 17 and bulged portions 16 from a rectangular sheet of aluminum alloy, and a punching process for punching out oval opening 16*a* from the bottom surface of each bulged portion 16. In the drawing process, shallow depression 120, semicylindrical projections 15, parallelepiped projections 17 and bulged portions 16 are formed by a plurality of drawing steps. The number of drawing steps required to form bulged portions 16 is greater than the number of drawing steps for forming the other above-mentioned elements because bulged portions 16 are more deeply and sharply depressed than the other elements. Therefore, the manufacturing of plate 12 becomes a complicated process. Furthermore, the large number of drawing steps necessary to form bulged portions 16 decreases the thickness of the aluminum alloy sheet at that point such that bulged portions 16 may be easily cracked in the drawing process. The cracking of bulged portions 16 must then be prevented by increasing the thickness of the rectangular sheet. However, this in turn unnecessarily increases the weight of plate 12, thus causing an unnecessary increase in the weight of evaporator 10, and unnecessarily decreasing the heat exchangeability of evaporator 10.

SUMMARY OF THE INVENTION

Accordingly, it is an object of the present invention to provide a heat exchanger which can be simply manufactured without increasing the weight thereof.

The heat exchanger includes a plurality of laminated tube units each comprising a pair of plates which define a fluid passage therebetween, and a pair of conduits for distributing a heat medium to the fluid passage of each of the tube units or receiving the heat medium from the fluid passage of each of the tube units. The pair of conduits is separately provided from the tube units.

DETAILED DESCRIPTION OF THE PREFERRED EMBODIMENTS

Figure 1:
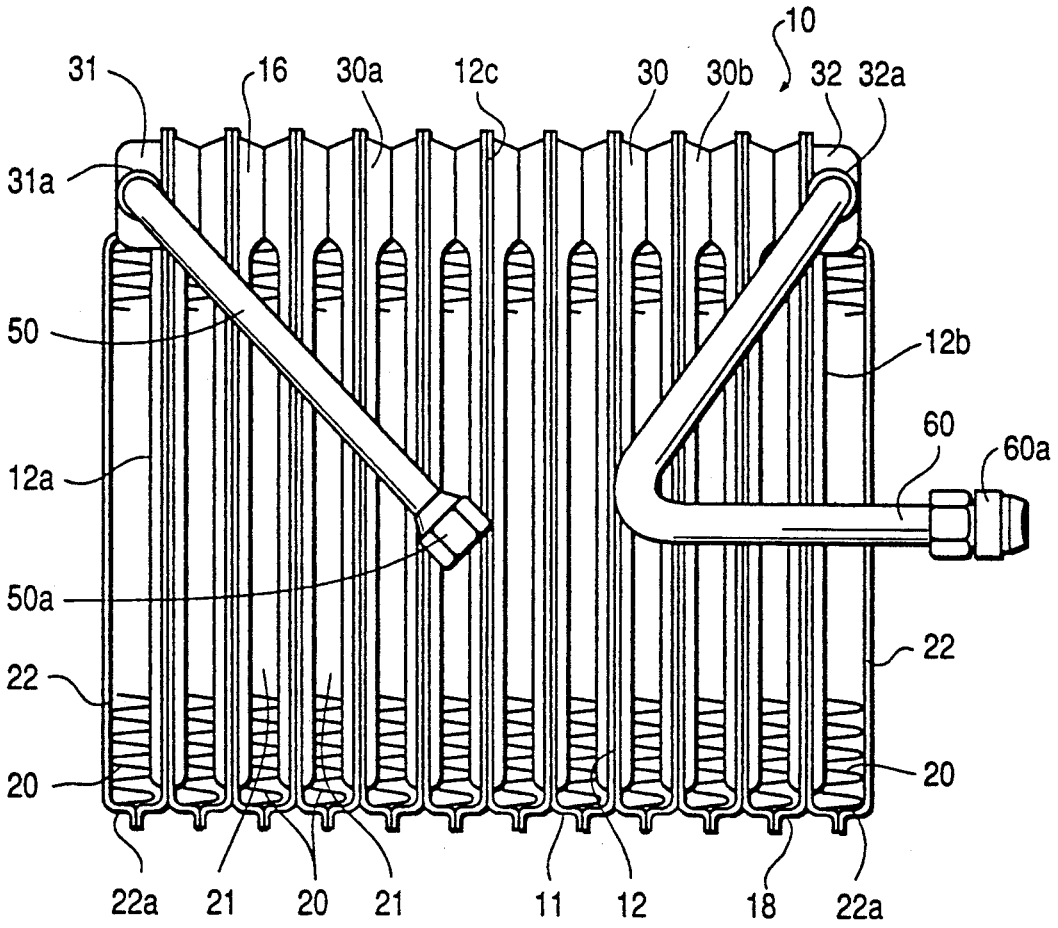
FIG. 1 PRIOR ART
FIG. 1 illustrates an overall front view of a laminated type evaporator in accordance with a prior art embodiment.
Figure 2:
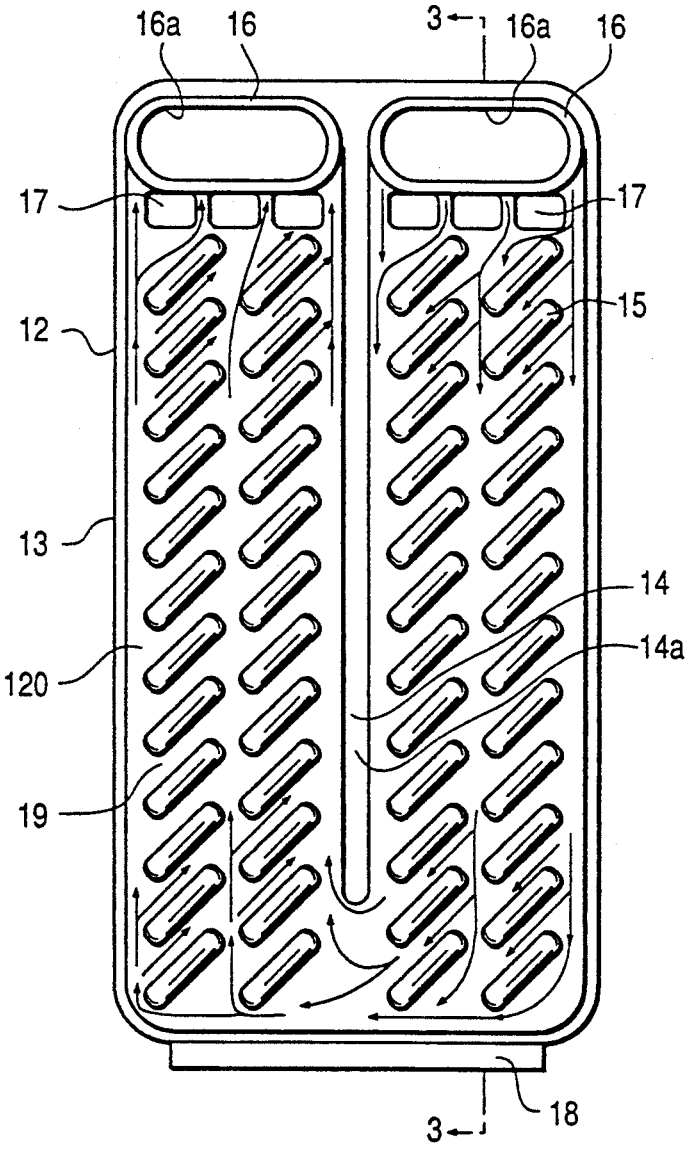
FIG. 2 PRIOR ART
FIG. 2 illustrates a side view of a tube unit of the evaporator shown in FIG. 1.
Figure 3:
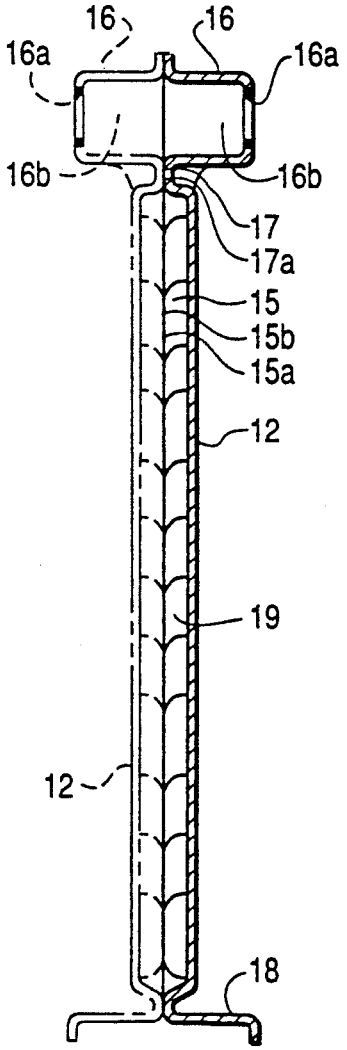
FIG. 3 PRIOR ART
FIG. 3 illustrates a cross section taken along line 3—3 of FIG. 2.
Figure 4:
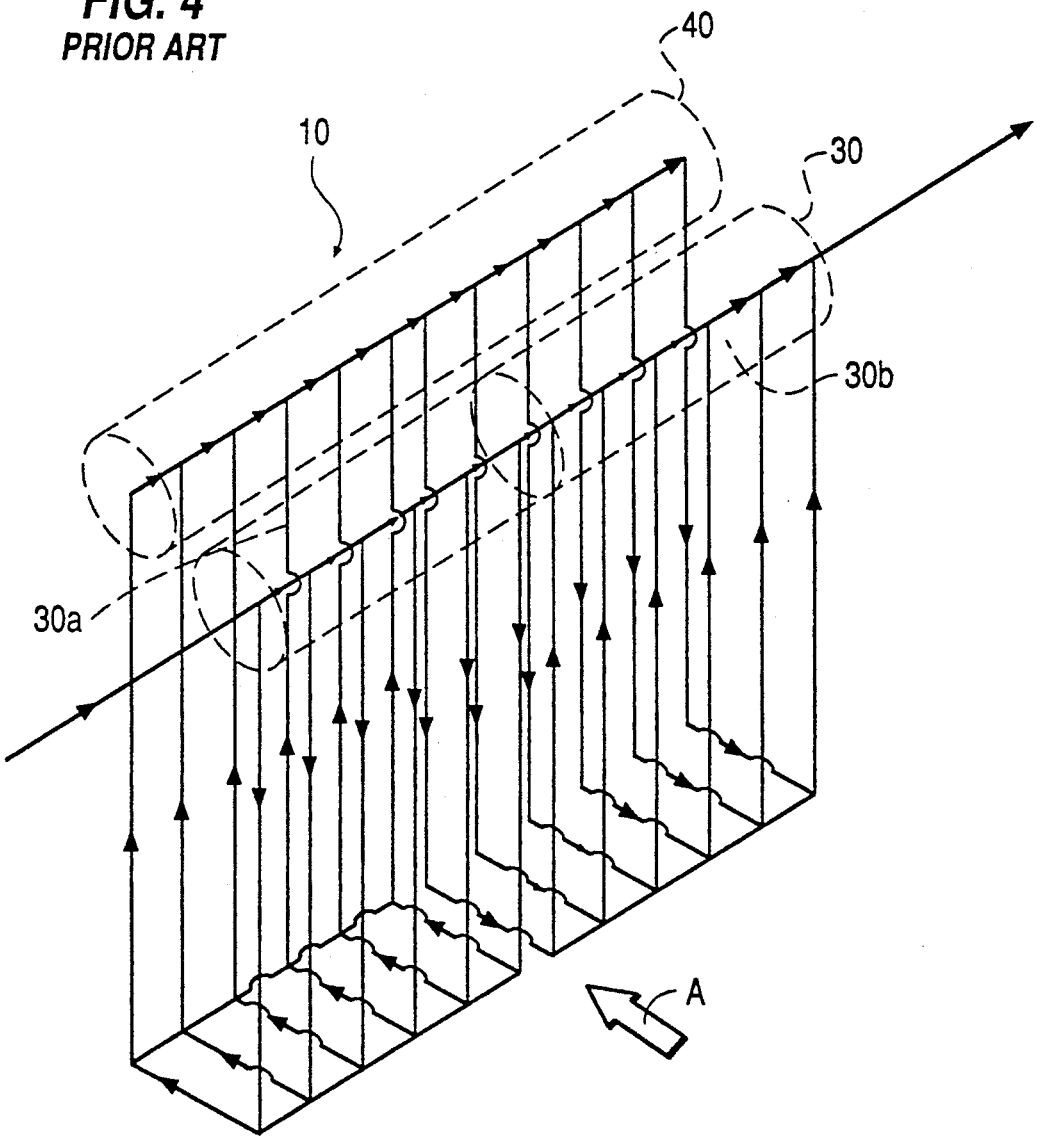
FIG. 4 PRIOR ART
FIG. 4 is a schematic view showing the flow path of the refrigerant flowing through the interior of the laminated type evaporator shown in FIG. 1.

FIGS. 5–8 illustrate a first embodiment of the present invention, and FIGS. 10–14 illustrate the second through sixth embodiments of the present invention, respectively. In the drawings, like reference numerals are used to denote elements corresponding to those shown in FIGS. 1–3 and a detailed explanation thereof is therefore omitted. Furthermore, the general function and effect of the second through sixth embodiments of the present invention are similar to the first embodiment of the present invention such that a detailed explanation thereof is likewise omitted.

The construction of a laminated type evaporator in accordance with a first embodiment of the present invention is shown in FIGS. 5-8. The laminated type evaporator 200 includes a plurality of tube units 201 of aluminum alloy each of which comprises a pair of tray-shaped plates 202.

Each of tray-shaped plates 202 includes a tapered connecting tongue 203 projecting upwardly from the upper end thereof. One of the tongues 203 is disposed to the right of narrow wall 14, and the other tongues 203 is disposed to the left thereof. A depression 203*a* is formed in the central region of tongue 203, longitudinally extends from the upper end to the lower end thereof, and is linked to shallow depression 120 of plate 202. The bottom surface of depression 203*a* is formed even with the plane of the inner bottom surface of shallow depression 120. A pair of diagonally disposed semicylindrical projections 204 are formed on the bottom surface of depression 203*a*. Semicylindrical projections 204 reinforce the mechanical strength of tongues 203. Semicylindrical projections 204 are longitudinally aligned with each other and are offset from the two rows of semicylindrical projections 15 formed in shallow depression 120.

The flat top end surface of each of truncated semicylindroids 203 is formed even with the plane of flange 13. The pair of tray-shaped plates 202 are joined together at flanges 13 and the top end surfaces of tongues 203, so as to enclose therebetween a passage 205. Opposing semicylindrical projections 204 on the pair of tray-shaped plates 202 contact one another at intersections 204*b* formed between their ridges 204*a*. The flat top end surfaces of tongues 203 are fixedly attached to one another by, for example, brazing, thereby forming a pair of tapered hollow connecting portions 210.

Figure 6:
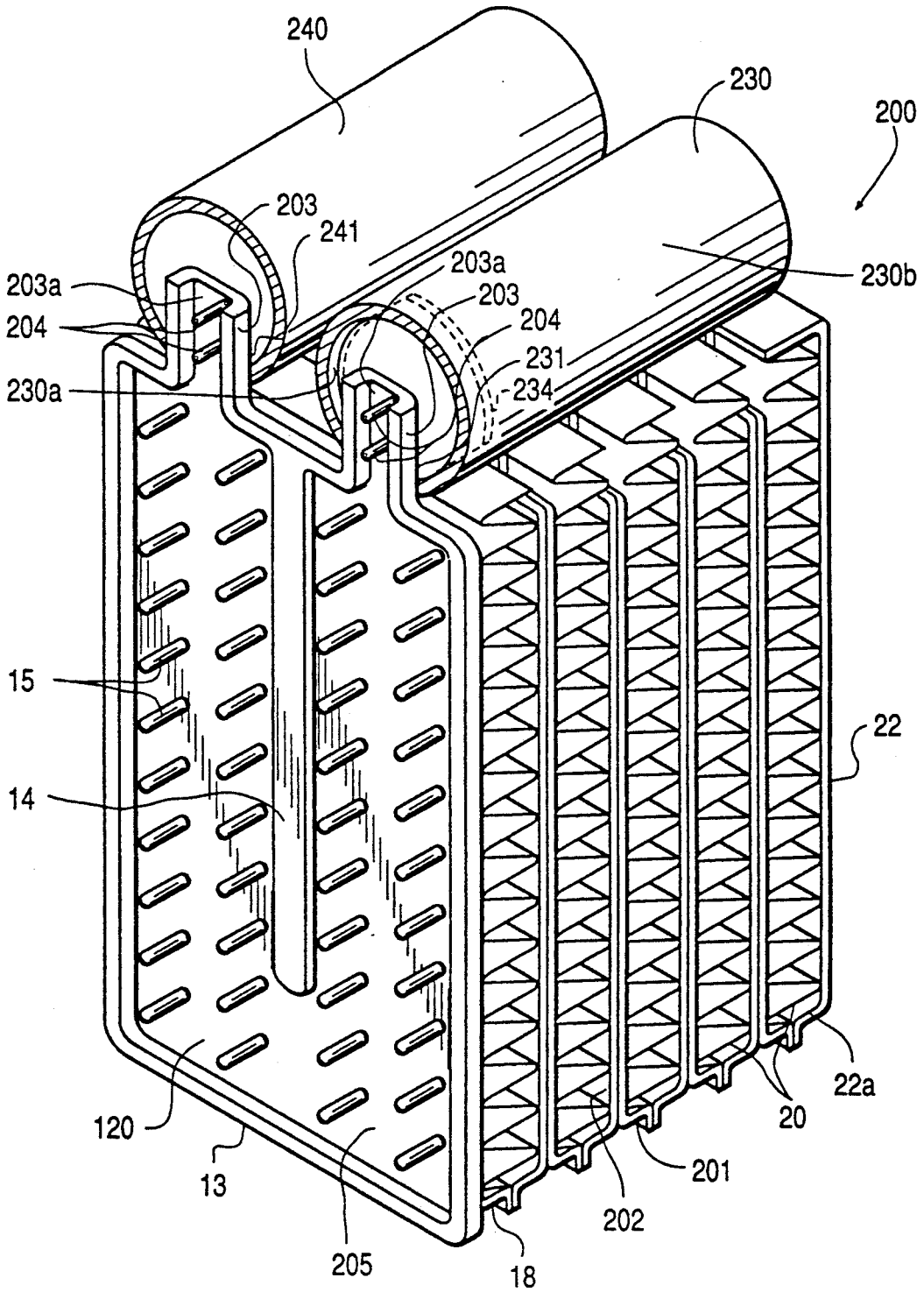
FIG. 6 illustrates a perspective cut-away view of the laminated type evaporator shown in FIG. 5.
Figure 7:
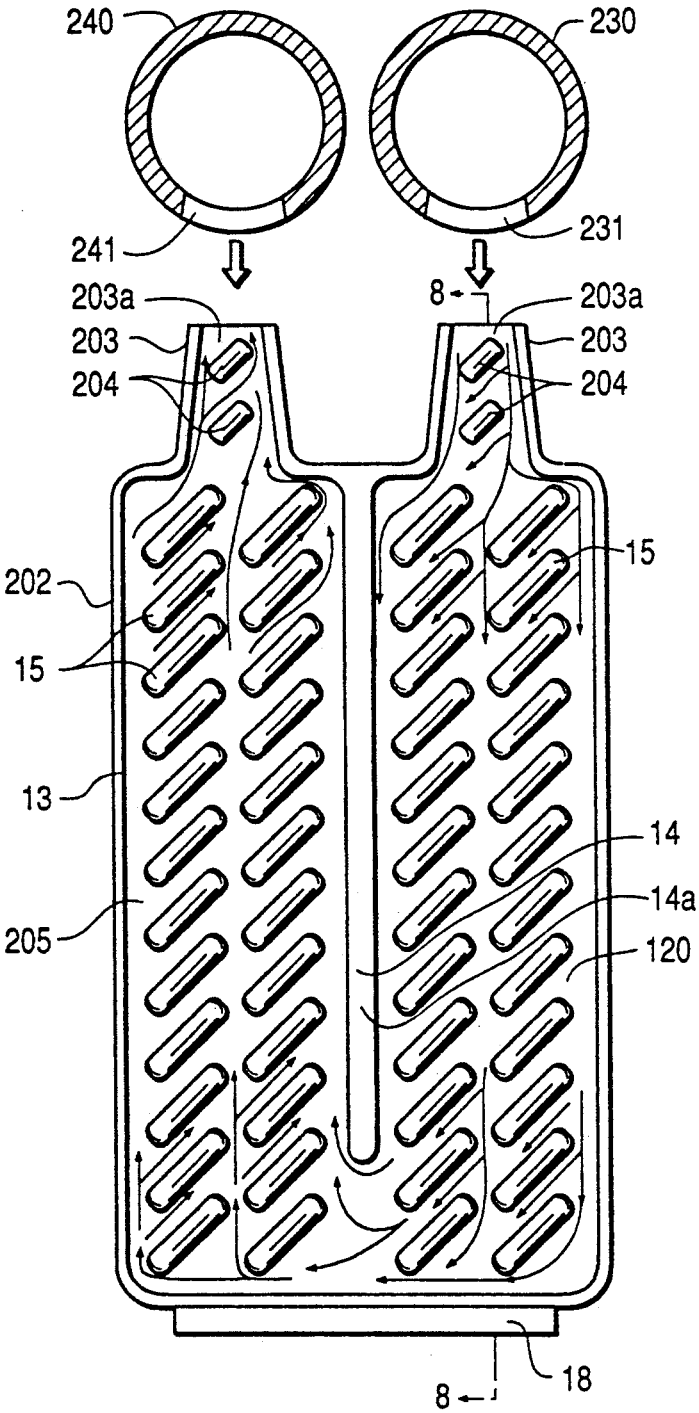
FIG. 7 illustrates a side view of a tube unit of the evaporator shown in FIG. 6.
Figure 8:
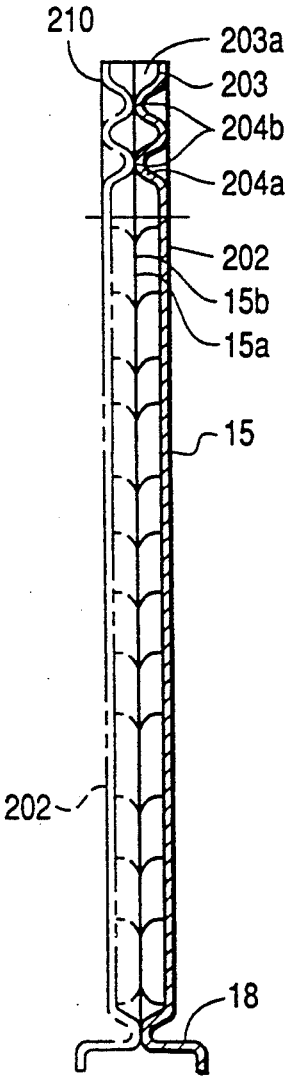
FIG. 8 illustrates a cross section taken along line 8—8 of FIG. 7.

Laminated type evaporator 200 further includes a pair of parallel closed ended cylindrical pipes 230 and 240 situated above the upper surface of laminated tube units 201. As illustrated in FIG. 6, cylindrical pipe 230 is positioned in front of cylindrical pipe 240. A plurality of generally oval-shaped slots 231 are formed along the lower curved surface of cylindrical pipe 230 at equal intervals. A plurality of generally oval-shaped slots 241 are also formed along the lower curved surface of cylindrical pipe 240 at equal intervals. Generally, oval-shaped slots 231 of pipe 230 are aligned with generally oval-shaped slots 241 of pipe 240 so as to receive the pair of hollow connecting portions 210 of tube units 201. The pair of annular hollow connecting portions 210 of tube units 201 are inserted into slots 231 and 241 until the lower end portion of connecting portions 210 contacts the inner peripheral surface of slots 231 and 241, respectively. The pair of annular hollow connecting portions 210 are fixedly attached to slots 231 and 241, respectively, by brazing or other conventional methods. A pair of circular openings 232 and 233 are formed at the left end and right end of cylindrical pipe 230, respectively, on the front curved surface thereof. Opening 233 is omitted in FIG. 6. One end of inlet pipe 50 is fixedly connected to opening 232 of cylindrical pipe 230 and one end of outlet pipe 60 is fixedly connected to opening 233 of cylindrical pipe 230.

Figure 5:
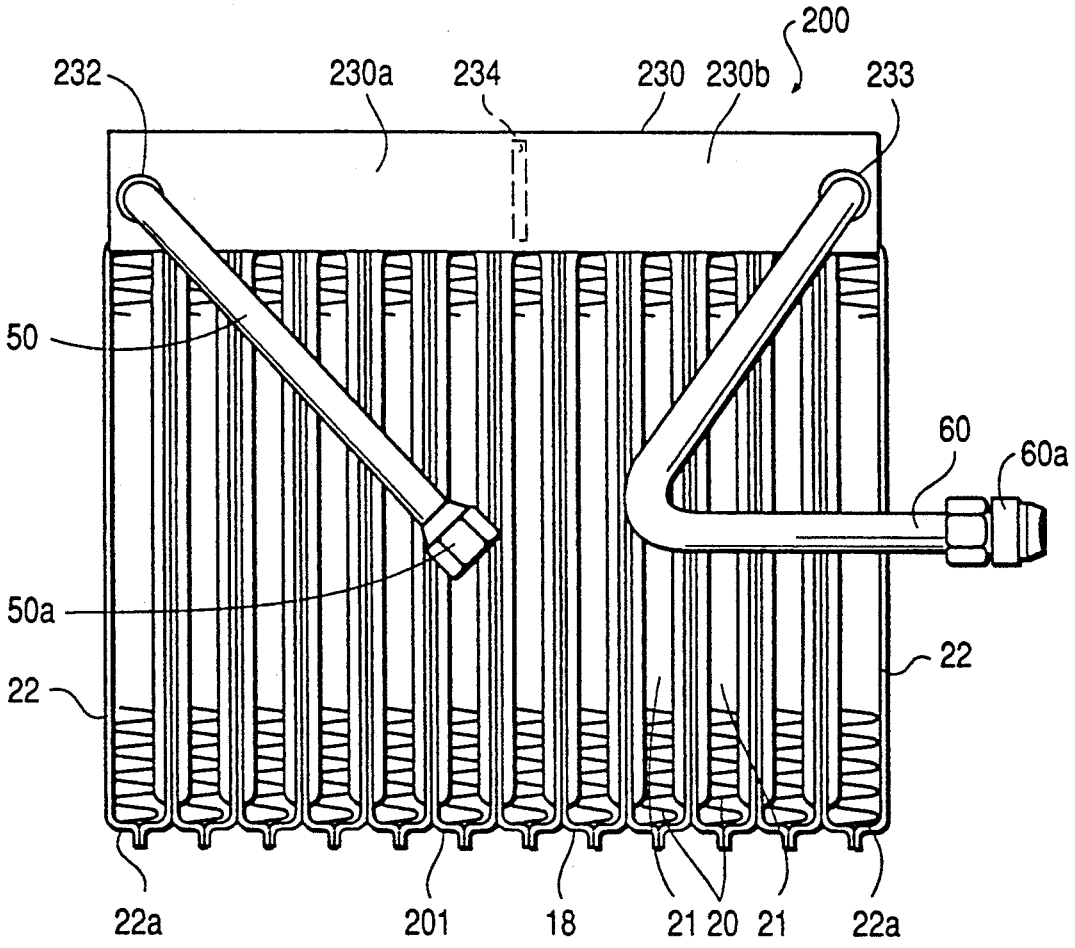
FIG. 5 illustrates an overall front view of a laminated type evaporator in accordance with a first embodiment of the present invention.

Circular plate 234 is fixedly disposed at an intermediate location within the interior region of cylindrical pipe 230 so as to divide the cylindrical pipe 230 into a left side section 230*a* and a right side section 230*b*, as shown in FIG. 5.

Figure 9:
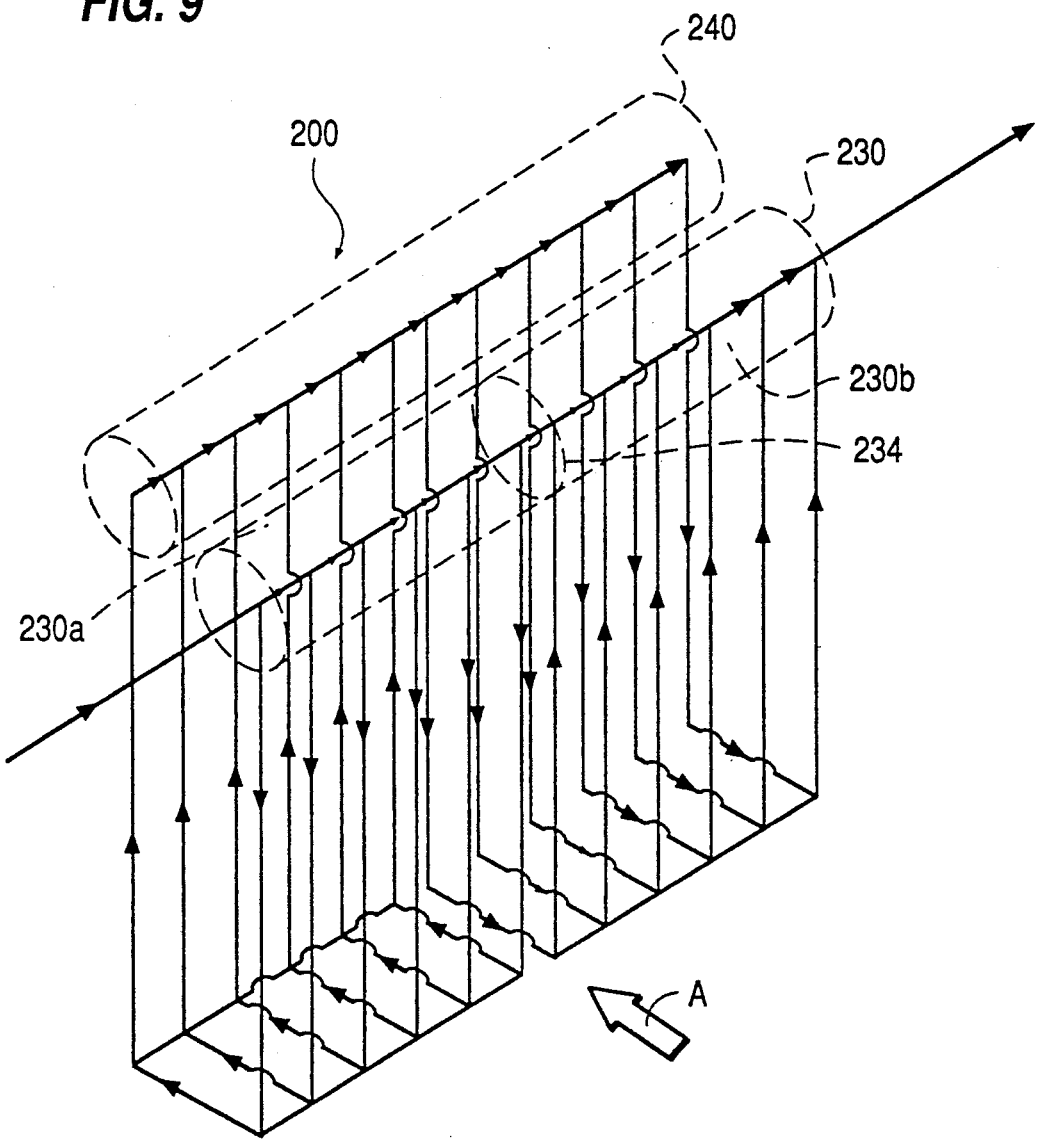
FIG. 9 is a schematic view showing the flow path of the refrigerant flowing through the interior of the laminated type evaporator shown in FIG. 5.

With reference to FIG. 9 additionally, in the above-described construction of the evaporator, when the automotive air conditioning refrigerant circuit operates the refrigerant flows from a condenser (not shown) of the refrigerant circuit via a throttling device, such as an expansion valve, through inlet pipe 50 into left side section 230*a* of the interior region of cylindrical pipe 230, and through left side section 230*a* in a left to right direction. The refrigerant flowing through left side section 230*a* of the interior region of pipe 230 concurrently flows through the interior region of hollow connecting portions 210 and into the upper right region of passage 205 in each of tube units 201. The refrigerant in the upper right region of passage 205 then flows downwardly to the lower right region of passageway 205 in a complex flow path, which includes diagonal and straight flow paths as shown by the solid arrows in FIG. 7, while also exchanging heat with the air passing along corrugated fins 20. The air passes through evaporator 200 from the front to the rear thereof, as shown by the large arrow "A" in FIG. 9. The refrigerant located in the lower right region of passage 205 is turned at the terminal end of narrow wall 14 and directed from the right side to the left side of passage 205, as shown by the solid arrows in FIG. 7. That is, the refrigerant flows from the front to the rear of passage 205, then flows upwardly to the upper left region of passage 205 in a complex flow path while further exchanging heat with the air passing along corrugated fins 20, and then finally flows out of passage 205 in each of tube units 201 through the interior hollow connecting portion 210. The refrigerant flowing out of passage 205 from each of tube units 201 combines in the interior region of cylindrical pipe 240 and flows therethrough in a direction from the left side to the right side thereof.

The refrigerant flowing through the interior region of the right side of cylindrical pipe 240 concurrently flows into the upper left region of passage 205 in each of tube units 201 through the interior hollow connecting portion 210. The refrigerant in the upper left region of passage 205 flows downwardly to the lower left region of passageway 205 in a complex flow path and exchanges heat with the air passing along corrugated fins 20. The refrigerant located in the lower left region of passage 205 is turned at the terminal end of narrow wall 14 and directed from the left side to the right side of passage 205. That is, the refrigerant flows from the rear to the front of passage 205, then flows upwardly to the upper right region of passage 205 in a complex flow path while further exchanging heat with the air passing along corrugated fins 20, and finally flows out of passage 205 from each of tube units 201 through the interior hollow connecting portions 210. The refrigerant flowing from passage 205 in each of tube units 201 combines in the right side section 230*b* of the interior region of cylindrical pipe 230 and flows therethrough in a direction from the left side to the right side thereof. The gaseous phase refrigerant located in the far right side of right side section 230*b* in the interior region of cylindrical pipe 230 flows through outlet pipe 60 to a suction chamber of a compressor (not shown) in the refrigerant circuit.

In the present invention, cylindrical pipes 230 and 240 function to distribute the refrigerant to each of the tube units or to receive the refrigerant from each of the tube units, and are separately provided from the tube units. Therefore, in contrast to the prior art discussed above, it is not required to form the bulged portions in the tube units in order to obtain the desired distribution of the refrigerant. Accordingly, the number of drawing steps involved in forming the tray-shaped plate of the tube unit can be limited to a value which avoids causing any portion of the tray-shaped plate to crack. Thus, the tray-shaped plate of the present invention can be made by a simple forming process. Furthermore, the unnecessary increase in the weight of the evaporator, which in turn caused the unnecessary decrease in the heat exchangeability of the prior art evaporator, is eliminated because in the present invention it is not necessary to thicken the aluminum alloy sheet to prevent cracking.

Figure 10:
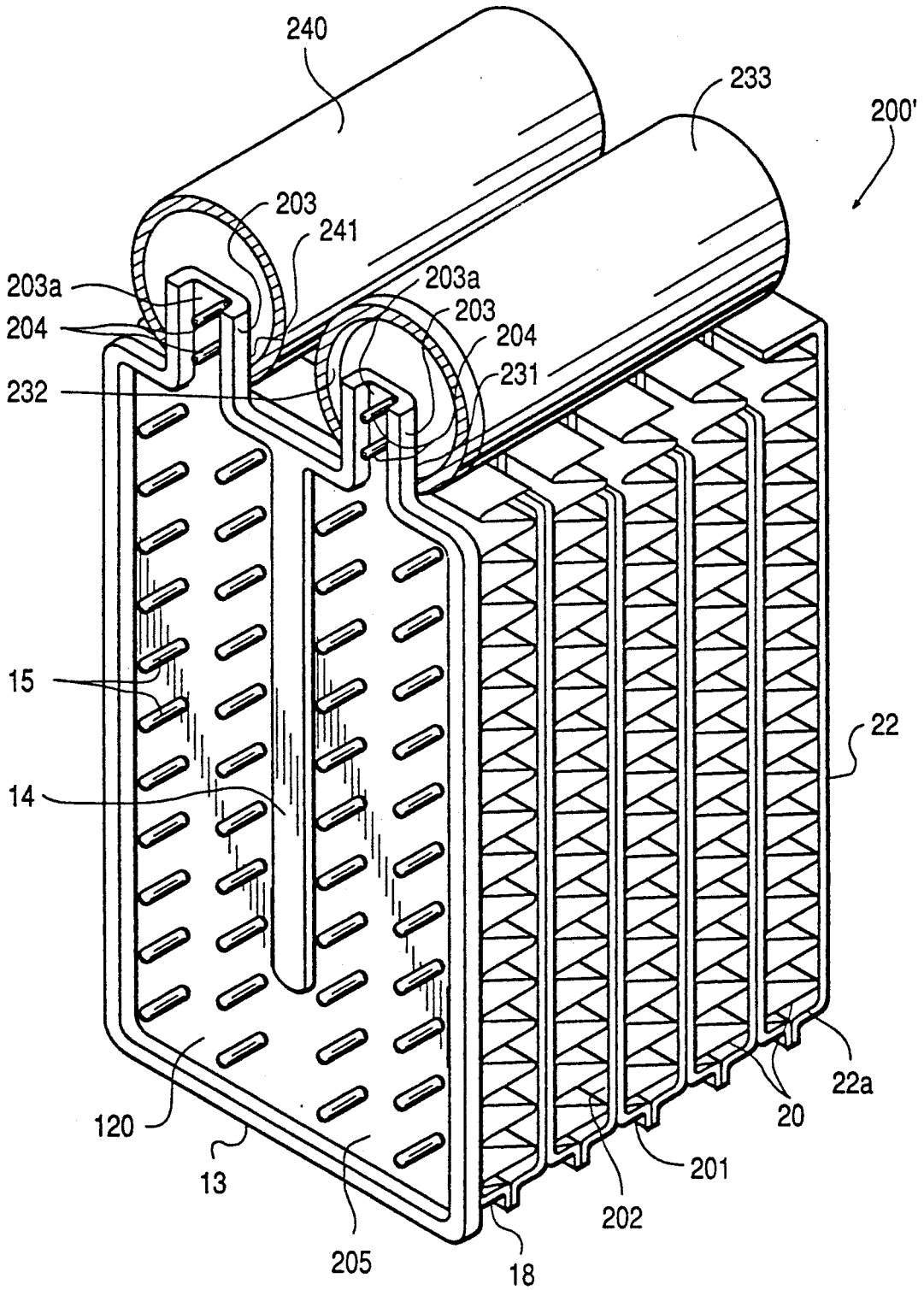
FIG. 10 illustrates a perspective cut-away view of a laminated type evaporator in accordance with a second embodiment of the present invention.

FIG. 10 illustrates a second embodiment of the present invention. In the second embodiment, a pair of closed ended cylindrical pipes 232 and 233 are positioned in series along the upper end of the laminated tube units 201 in place of cylindrical pipe 230 of the first embodiment. Cylindrical pipe 232 is located on the left side of evaporator 200' and cylindrical pipe 233 is located on the right side of evaporator 200'. The right closed end of cylindrical pipe 232 and the left closed end of cylindrical pipe 233 can either be fixedly connected to one another or left apart.

Figure 11:
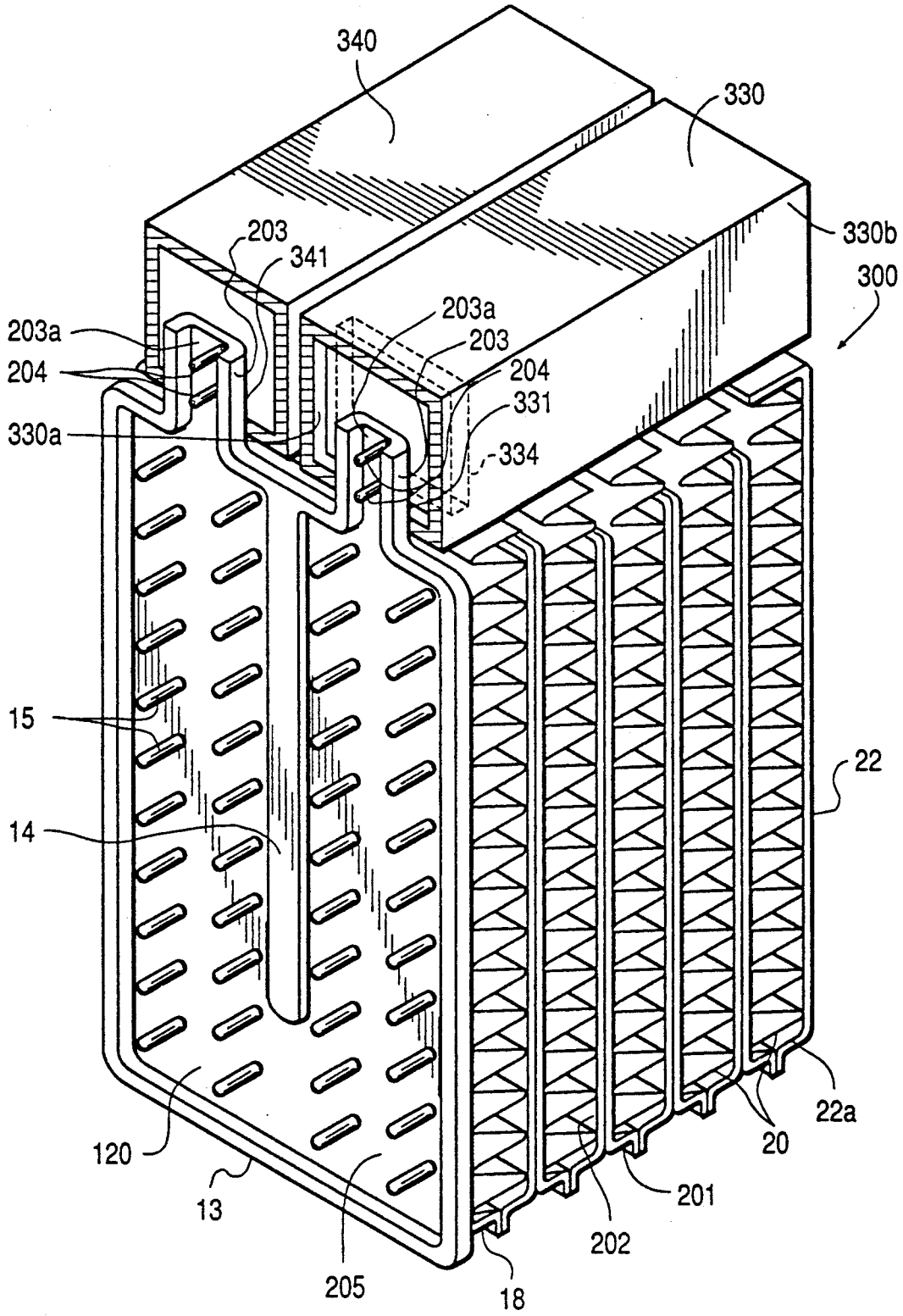
FIG. 11 illustrates a perspective cut-away view of a laminated type evaporator in accordance with a third embodiment of the present invention.

FIG. 11 illustrates a third embodiment of the present invention. In the third embodiment, a pair of closed ended rectangular parallelepipeds 330 and 340 are located along the upper end of the laminated tube units 201 in place of the pair of cylindrical pipes 230 and 240 of the first embodiment. Rectangular plate 334 is fixedly disposed at an intermediate location within rectangular parallelepiped 330 so as to divide the interior region thereof into a left side section 330*a* and a right side section 330*b*. A plurality of generally ovalshaped slots 331 are formed in the lower end surface of rectangular parallelepiped 330 at equal intervals and a plurality of generally ovalshaped slots 341 are also formed in the lower end surface of rectangular parallelepiped 340 at equal intervals. The lower end portions of tapered hollow connecting portions 210 of tube units 201 are fixedly connected to an inner peripheral surface of oval-shaped slots 331 and 341. Oval-shaped slots 331 and 341 are more easily formed in the lower end surfaces of rectangular parallelepipeds 331 and 341, in comparison to the formation of oval-shaped slots 231 and 241 in the cylindrical pipes of the first and second embodiments, due to the lower end surfaces of rectangular parallelepipeds 331 and 341 being planar.

Figure 12:
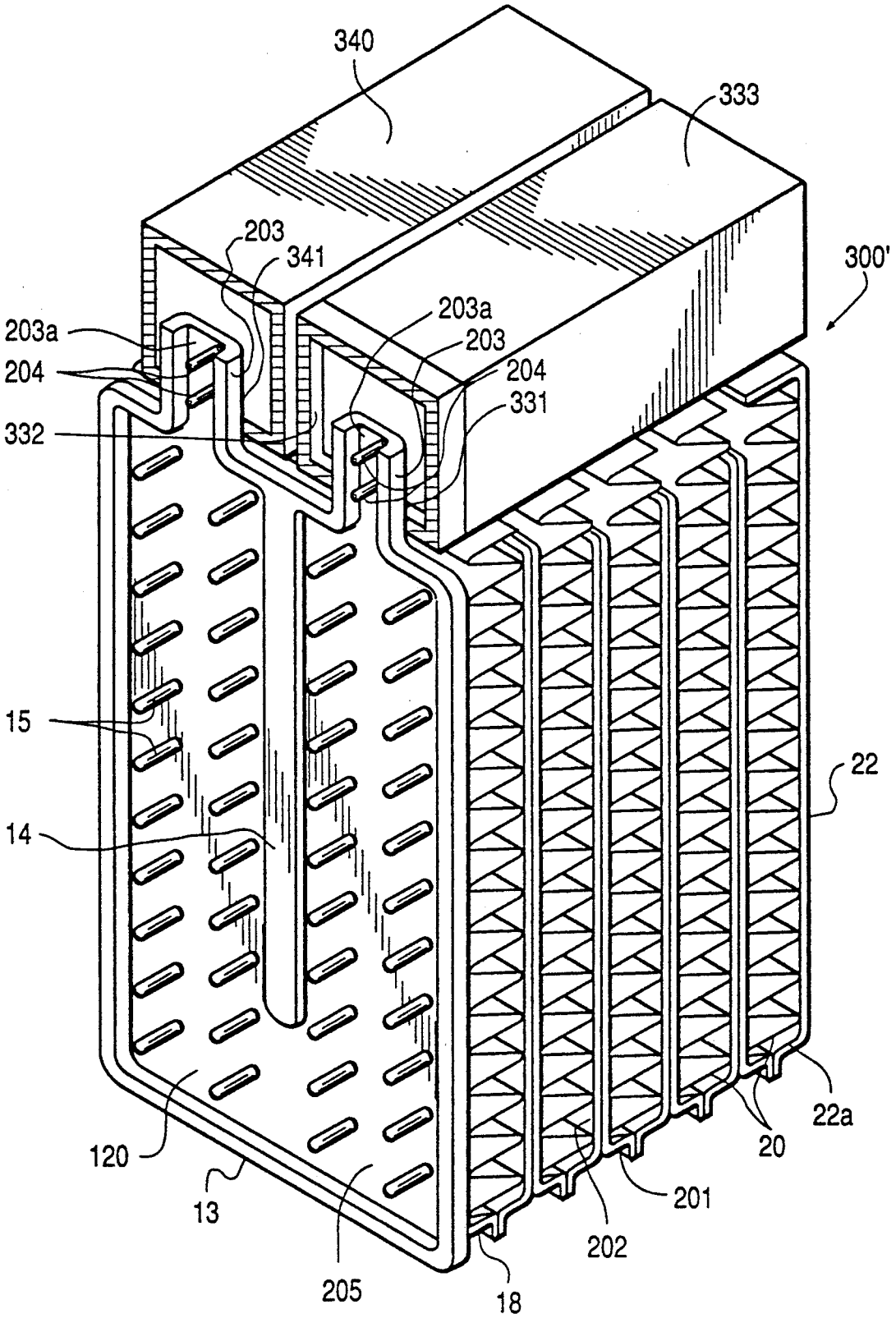
FIG. 12 illustrates a perspective cut-away view of a laminated type evaporator in accordance with a fourth embodiment of the present invention.

FIG. 12 illustrates a fourth embodiment of the present invention. In the fourth embodiment, a pair of closed ended rectangular parallelepipeds 332 and 333 are positioned in series along the upper end of the laminated tube units 201 in place of rectangular parallelepiped 330 of the third embodiment. Rectangular parallelepiped 332 is located at the left side of evaporator 300 and rectangular parallelepiped 333 is located at the right side of evaporator 300'. The right closed end of rectangular parallelepiped 332 and the left closed end of rectangular parallelepiped 333 can either be fixedly connected to each other or left unconnected.

Figure 13:
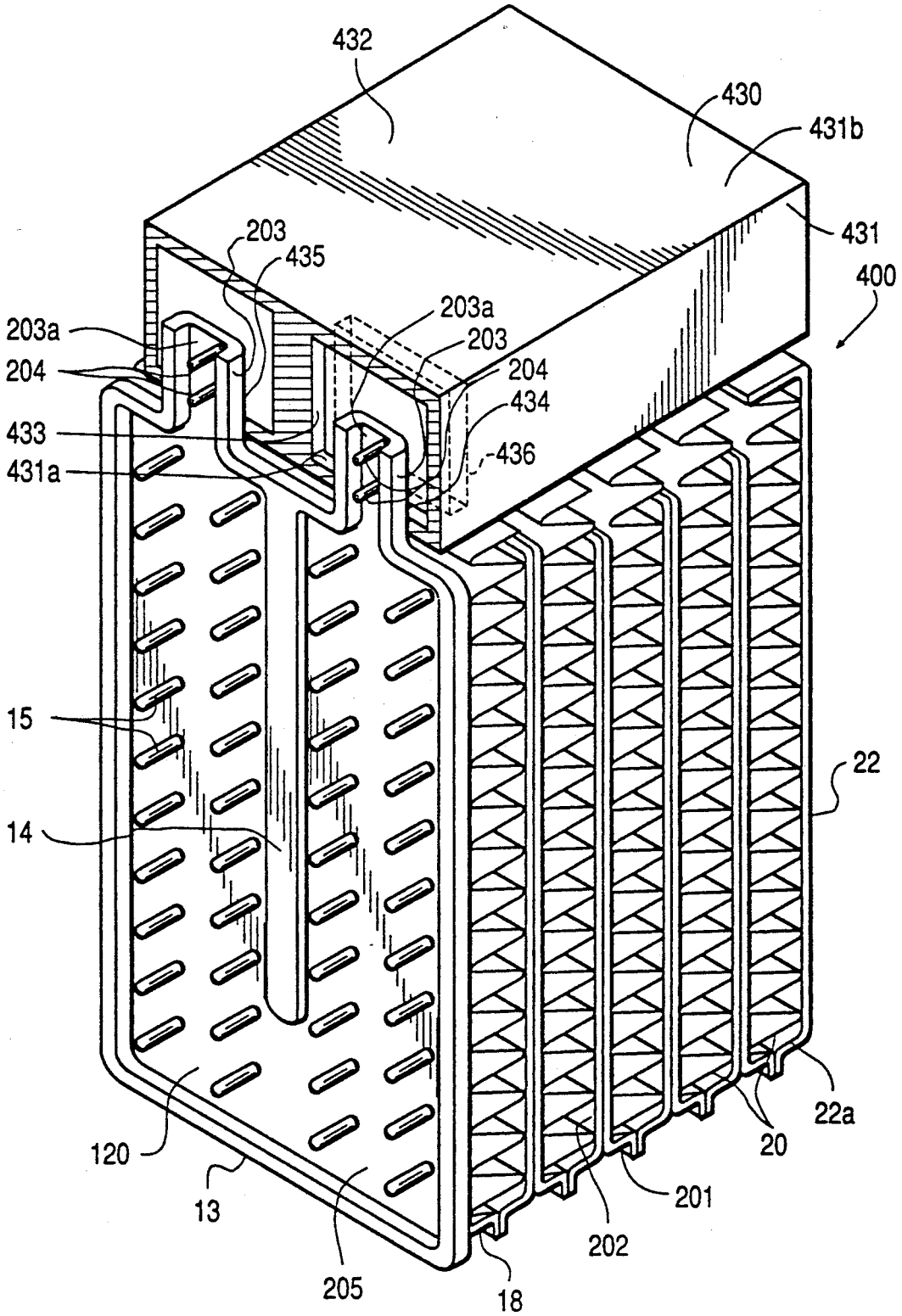
FIG. 13 illustrates a perspective cut-away view of a laminated type evaporator in accordance with a fifth embodiment of the present invention.

FIG. 13 illustrates a fifth embodiment of the present invention. In the fifth embodiment, a closed ended rectangular parallelepiped 430 is located along the upper end of the laminated tube units 201 in place of the pair of rectangular parallelepipeds 330 and 340 of the third embodiment. The interior region of rectangular parallelepiped 430 is divided into front and rear sections 431 and 432 by a rectangular wall 433 formed at an intermediate location. A plurality of generally oval-shaped slots 434 are formed in the lower end surface of front section 431 of rectangular parallelepiped 430 at equal intervals and a plurality of generally oval-shaped slots 435 are also formed in the lower end surface of rear section 432 of rectangular parallelepiped 430 at equal intervals. Rectangular plate 436 is fixedly disposed at an intermediate location in front section 431 so as to divide front section 431 into a left side sub-section 431*a* and a right side sub-section 431*b*.

Figure 14:
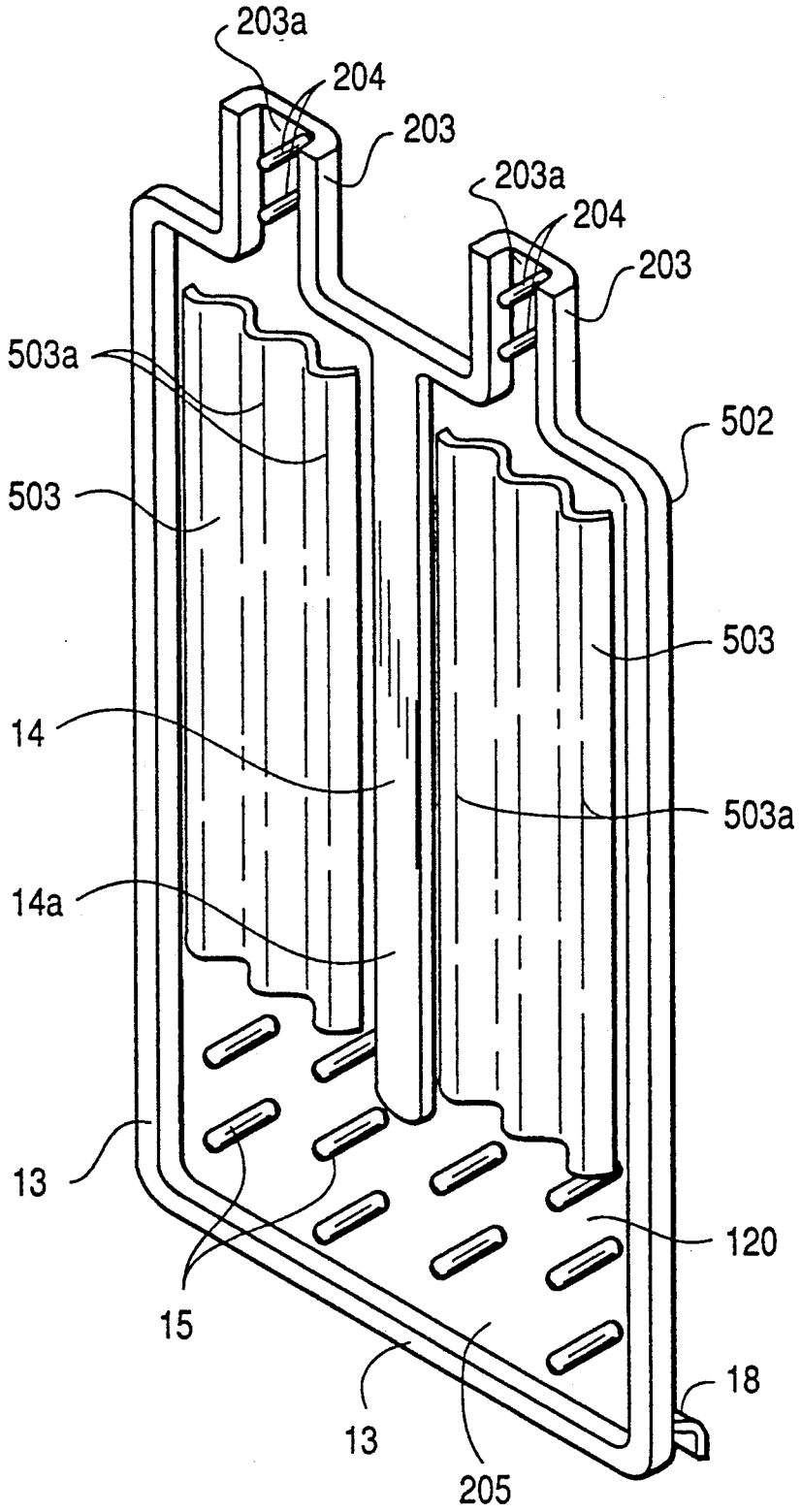
FIG. 14 illustrates a perspective view of a tube unit of a laminated type evaporator in accordance with a sixth embodiment of the present invention.

FIG. 14 illustrates a sixth embodiment of the present invention. Tray-shaped plate 502 is provided with a pair of corrugated plates 503 fixedly disposed on the bottom surface of shallow depression 120 in place of semicylindrical projections 15. Corrugated plates 503 extend from the upper end of shallow depression 120 to a point approximately even with the terminal end of narrow wall 14. Corrugated plate 503 includes a plurality of axial ridges 503*a* extending along the length thereof.

One of the pair of corrugated plates 503 is located on the right side of shallow depression 120, with respect to narrow wall 14, and the other corrugated plate 503 is located on the left side of shallow depression 120. The level of ridges 503*a* is even with the level of flange 13. Therefore, when the pair of tray-shaped plates 502 are joined together by flanges 13, ridges 503*a* of corrugated plates 503 are also brought into contact with one another.

It should be apparent to one skilled in the art that tray-shaped plate 502 could be substituted for tray-shaped plate 202 that was provided for tube unit 201 of the first through fifth embodiments.

This invention has been described in detail in connection with the preferred embodiments. These embodiments, however, are merely for example only and the invention is not restricted thereto. It will be understood by those skilled in the art that other variations and modifications can easily be made within the scope of this invention, as such is defined by the appended claims.

I claim:

1. A heat exchanger comprising:

a plurality of laminated tube units, each of said tube units including a pair of plates joined together to define therebetween a fluid passageway and at least one generally tubular opening projecting upwards from a top surface of said pair of plates and linked in fluid communication with said fluid passageway; and at least one conduit separately formed and disposed on an upper surface of said plurality of laminated tube units, said at least one conduit including a plurality of equiinterval slots in the bottom surface thereof;

wherein said at least one conduit is positioned on said plurality of tube units such that said at least one generally tubular opening is received in one of said equiinterval slots and fluid communication between said plurality of tube units is thereby obtained through said at least one conduit; and wherein each of said pair of plates includes a shallow depression defined therein, a flange extending about the periphery thereof, and a wall disposed at an intermediate location therein and extending a majority of the length of said plate, said wall thereby defining a left side and a right side of said plate.

2. The heat exchanger of claim 1 wherein each of said pair of plates further includes a plurality of projections extending from the bottom surface of said depression.

3. The heat exchanger of claim 1 wherein each of said pair of plates further includes with the depression a corrogated sheet having a plurality of axial ridges disposed on the bottom surface of said depression.

4. The heat exchanger of claim 1 wherein said at least one conduit comprises a pair of generally rectangular pipes having two closed ends.

5. The heat exchanger of claim 4 wherein one of said pair of generally rectangular pipes includes a dividing plate disposed therein to thereby divide said conduit into a left side section and a right side section.

6. A heat exchanger comprising:

a plurality of laminated tube units, each of said tube units including a pair of plates joined together to define therebetween a fluid passageway and at least one tapered hollow connecting portion projecting upwards from a top surface of said pair of plates and linked in fluid communication with said fluid passageway; and at least one conduit separately formed and disposed on an upper surface of said plurality of laminated tube units, said at least one conduit including a plurality of equiinterval slots in the bottom surface thereof;

wherein said at least one conduit is positioned on said plurality of tube units such that said hollow connecting portion is received in one of said equiinterval slots and fluid communication between said plurality of tube units is thereby obtained through said at least one conduit.

7. A heat exchanger comprising:

a plurality of laminated tube units, each of said tube units including a pair of plates joined together to define therebetween a fluid passageway and at least one tapered hollow connecting portion projecting upwards from a top surface of said pair of plates and linked in fluid communication with said passageway; and a pair of cylindrical pipes having two closed ends and disposed on an upper surface of said plurality of laminated tube units, said cylindrical pipes each including a plurality of equiinterval slots in the bottom surface thereof, each of said pipes having two closed ends and positioned in series on the upper surface of said plurality of laminated tube units;

wherein said pipes are positioned on said plurality of tube units such that said hollow connecting portion is received in one of said equiinterval slots and fluid communication between said plurality of tube units is thereby obtained through said pipes.

8. A heat exchanger comprising:

a plurality of laminated tube units, each of said tube units including a pair of plates joined together to define therebetween a fluid passageway and at least one tapered hollow connecting portion projecting upwards from a top surface of said pair of plates and linked in fluid communication with said fluid passageway; and a pair of generally rectangular pipes having two closed ends separately formed and disposed on an upper surface of said plurality of laminated tube units, said pair of generally rectangular pipes including a plurality of equiinterval slots in the bottom surface thereof;

wherein said pipes are positioned on said plurality of tube units such that said at least one connecting portion is received in one of said equiinterval slots and fluid communication between said plurality of tube units is thereby obtained through said pipes.

9. A heat exchanger comprising:

a plurality of laminated tube units, each of said tube units including a pair of plates joined together to define therebetween a fluid passageway and at least one tapered hollow connecting portion projecting upwards from the top surface of said pair of plates and linked in fluid communication with said fluid passageway; and a generally rectangular structure having an interior region that is divided into a first rectangular passage and a second rectangular passage by a dividing wall extending the length thereof separately formed and disposed on an upper surface of said plurality of said laminated tube units, said rectangular structure including a plurality of equiinterval slots in the bottom surface thereof;

wherein said rectangular structure is positioned on said plurality of tube units such that said at least one hollow connecting portion is received in one of said equiinterval slots and fluid communication between said plurality of tube units is thereby obtained through said rectangular structure.

10. The heat exchanger of claim 9 wherein one of said first rectangular passage and said second rectangular passage includes a dividing plate disposed therein, thereby further dividing said passage into a left side and a right side.

11. A method for manufacturing a heat exchanger comprising the steps of:

forming a pair of conduits;

forming spaced openings in one side of each said conduit;

forming a plurality of relatively shallow tray shaped plates having a depression therein, each having a pair of spaced, tapered, dished tongue portions at one end thereof;

joining a pair of said tray shaped plates to form a plurality of tube members having a pair of spaced, hollow connecting portions at one end;

arranging said conduits in side by side relation;

inserting said hollow connecting portions into each of said spaced openings; and connecting said tubes to said conduits with said connecting portions extending into said holes.

12. The method of claim 11 and also including the step of forming a plurality of projections in each said plate extending into said depression.

13. The method of claim 12 wherein said projections are formed in an arrangement wherein like projections formed in connected plates are in contact when said plates are connected.

14. The method of claim 13 wherein said step of connecting said tubes to said conduits includes brazing.

* * * * *